US007451694B1

(12) United States Patent
Wang

(10) Patent No.: US 7,451,694 B1
(45) Date of Patent: Nov. 18, 2008

(54) ROLL PRESSING MACHINE

(75) Inventor: Spencer Wang, Tainan (TW)

(73) Assignee: Boltun Corporation, Tainan Hsien (TW)

( * ) Notice: Subject to any disclaimer, the term of this patent is extended or adjusted under 35 U.S.C. 154(b) by 0 days.

(21) Appl. No.: 11/856,629

(22) Filed: Sep. 17, 2007

(51) Int. Cl.
*B30B 3/04* (2006.01)
*B21B 13/00* (2006.01)

(52) U.S. Cl. ..... 100/171; 100/172; 100/176; 72/199

(58) Field of Classification Search ..... 100/155 R, 100/163 R, 164, 168, 169, 171, 172, 176; 72/199
See application file for complete search history.

(56) References Cited

U.S. PATENT DOCUMENTS 2,578,594 A * 12/1951 Putnam ..... 100/166
3,866,532 A * 2/1975 Ogden, Jr. ..... 100/171
4,099,484 A * 7/1978 Ohno ..... 399/339
5,242,361 A * 9/1993 Brown et al. ..... 492/7
5,738,007 A * 4/1998 Roerig et al. ..... 100/327

* cited by examiner

*Primary Examiner*—Jimmy T Nguyen
(74) *Attorney, Agent, or Firm*—DLA Piper LLP (US)

(57) ABSTRACT

A roll pressing machine includes a support, a stationary roller unit disposed on the support and having a stationary roller, a self-modulating roller unit, a swingable body, and a biasing unit. The self-modulating roller is disposed movably on the support and has a moving roller adapted for pressing a blank against the stationary roller. The moving roller is movable toward or away from the stationary roller to vary a gap between the stationary and moving rollers. The swingable body is coupled to the moving roller. The biasing unit includes a pusher member pushing resiliently the swingable body so that the moving roller moves toward the stationary roller.

5 Claims, 7 Drawing Sheets

ROLL PRESSING MACHINE

BACKGROUND OF THE INVENTION

1. Field of the Invention

The invention relates to a roll pressing machine, more particularly to a roll pressing machine for pressing a blank, such as a nut.

2. Description of the Related Art

As shown in FIGS. 1 and 2, a conventional roll pressing machine includes a pair of spaced apart rollers 83, and a conveying unit (not shown). When a normal nut 81 that has a screw hole 811 is conveyed to a position between the rollers 83, one end 812 of the nut 81 will be pressed by the rollers 83 so that the screw hole 811 tapers off at a portion 821 adjacent to the end 812 of the nut 81, thereby turning the nut 81 into a self-locking nut 82 (see FIG. 2) that can tightly engage a corresponding threaded rod (not shown) through the portion 821.

However, nuts 81 with a same specification may not have a uniform outer diameter due tounstable forming of the manufacturing process. Since the distance between the rollers 83 is fixed, when a plurality of the nuts 81 of the same specification are conveyed to the position between the rollers 83, the nuts 81 having a longer outer diameter will be pressed harder, and the extent that the screw holes 811 thereof contract will be large, thereby resulting in difficulty in engaging the threaded rod. Conversely, the extent that the screw holes 811 of the nuts 81 having a shorter outer diameter contract will be small due to less pressure applied thereto, thereby resulting in a poor locking effect.

SUMMARY OF THE INVENTION

Therefore, the object of the present invention is to provide a roll pressing machine that can apply varying pressures to blanks according to the different sizes thereof.

Accordingly, a roll pressing machine of the present invention comprises a support, a stationary roller unit disposed on the support and having a stationary roller, a self-modulating roller unit, a swingable body, and a biasing unit. The self-modulating roller is disposed movably on the support and has a moving roller adapted for pressing a blank against the stationary roller. The moving roller is movable toward or away from the stationary roller to vary a gap between the stationary and moving rollers. The swingable body is coupled to the moving roller. The biasing unit includes a pusher member pushing resiliently the swingable body so that the moving roller moves toward the stationary roller.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
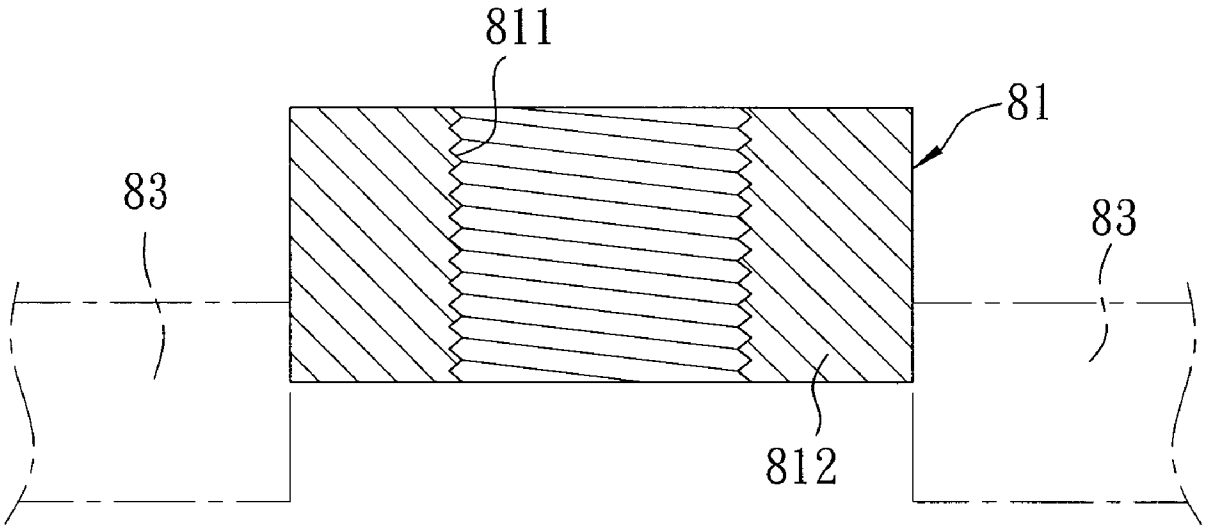
FIG. 1 PRIOR ART
FIG. 1 is a sectional view of a normal nut, illustrating how it is pressed by a conventional roll pressing machine.
Figure 2:
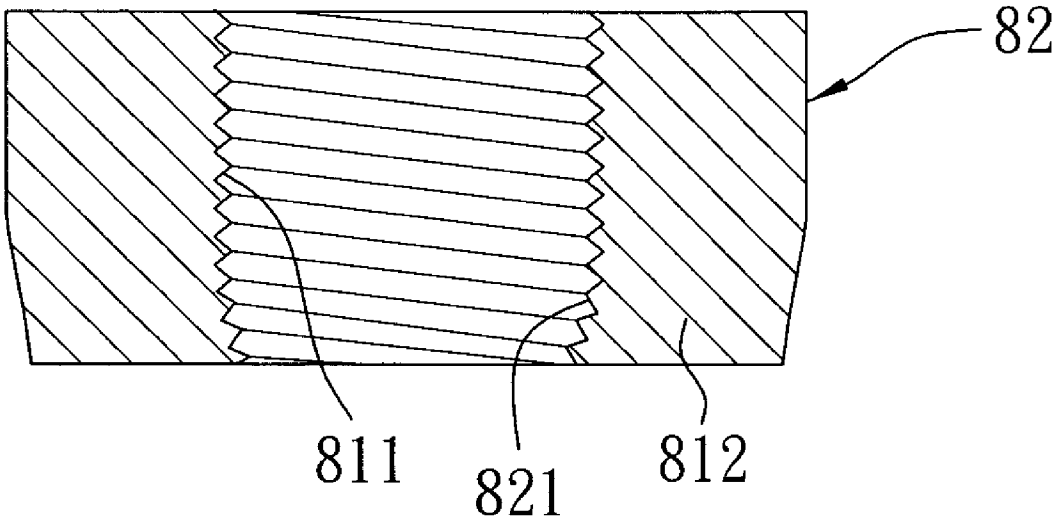
FIG. 2 PRIOR ART
FIG. 2 is a sectional view of a self-locking nut formed from the normal nut.
Figure 3:
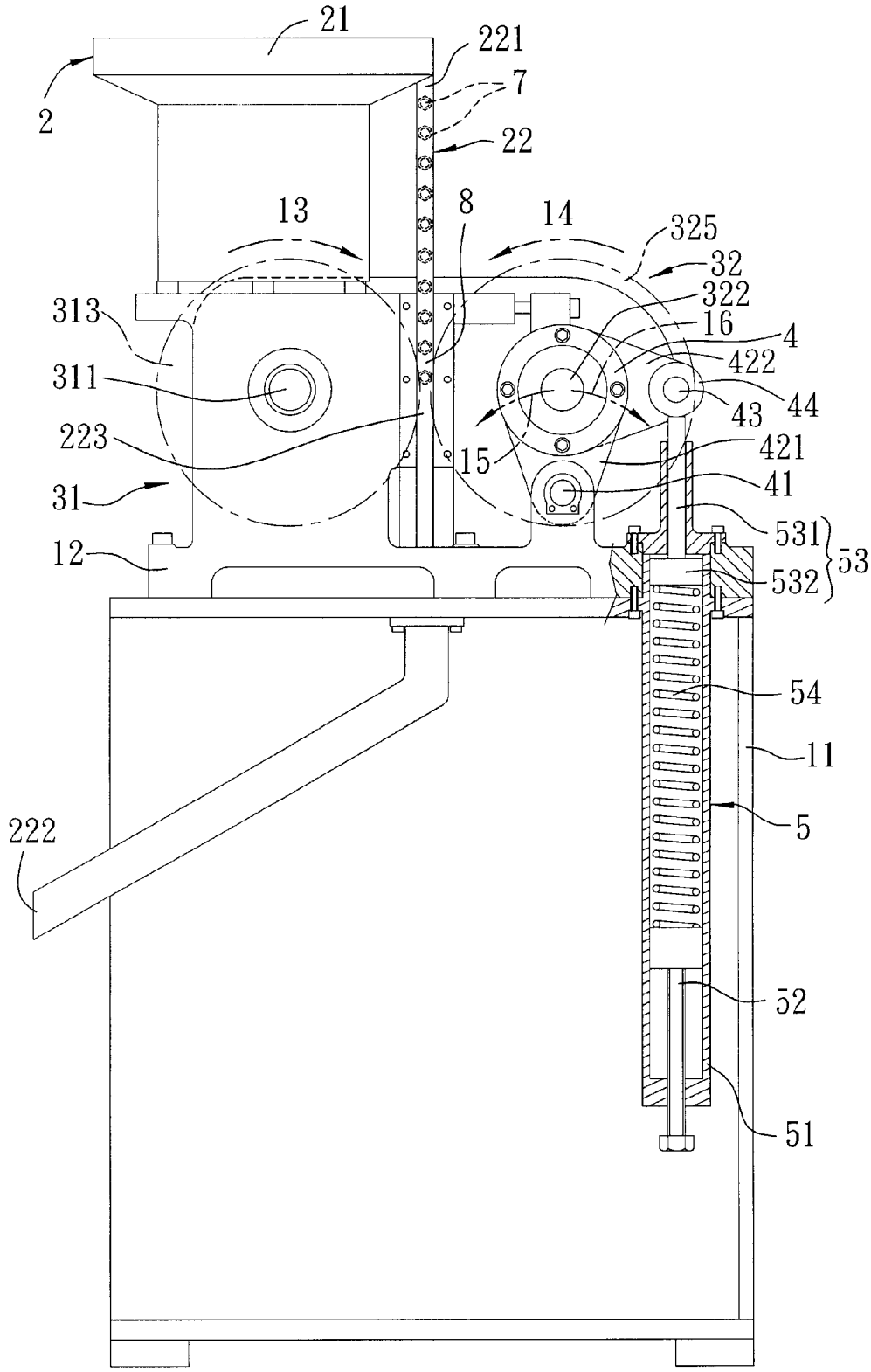
FIG. 3 is a partly sectional front view of a preferred embodiment of a roll pressing machine according to the invention.
Figure 4:
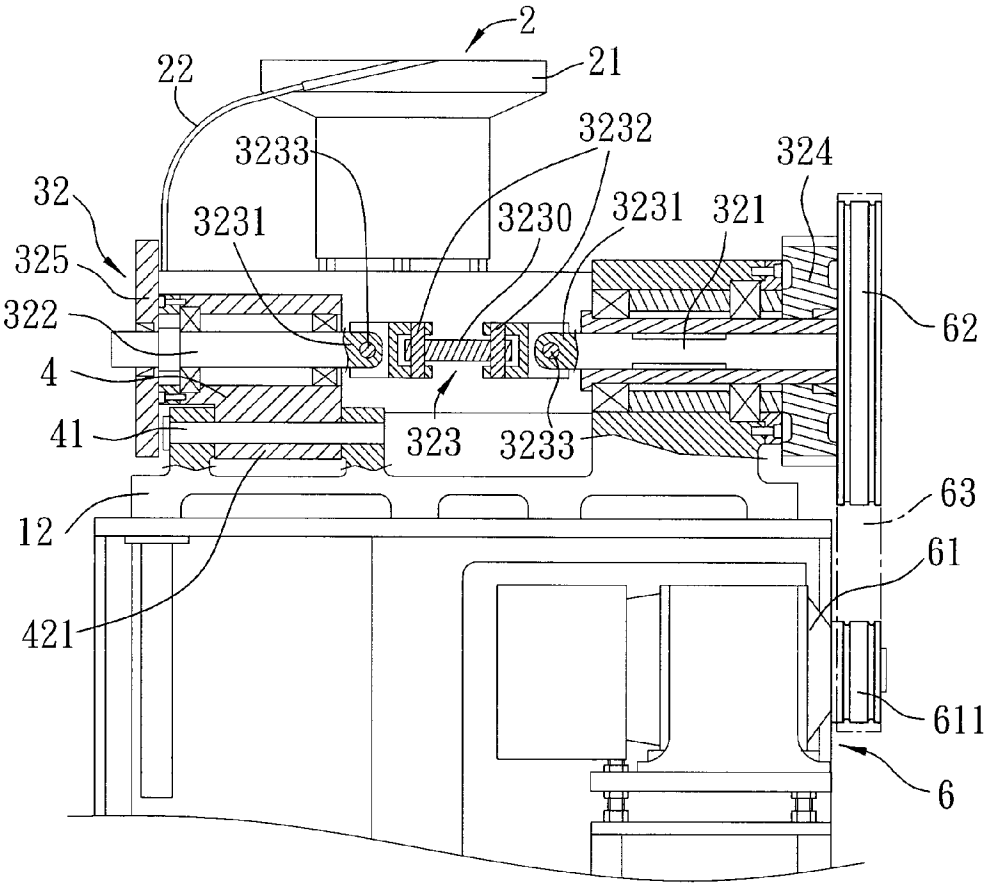
FIG. 4 is a partly sectional side view of the preferred embodiment.
Figure 5:
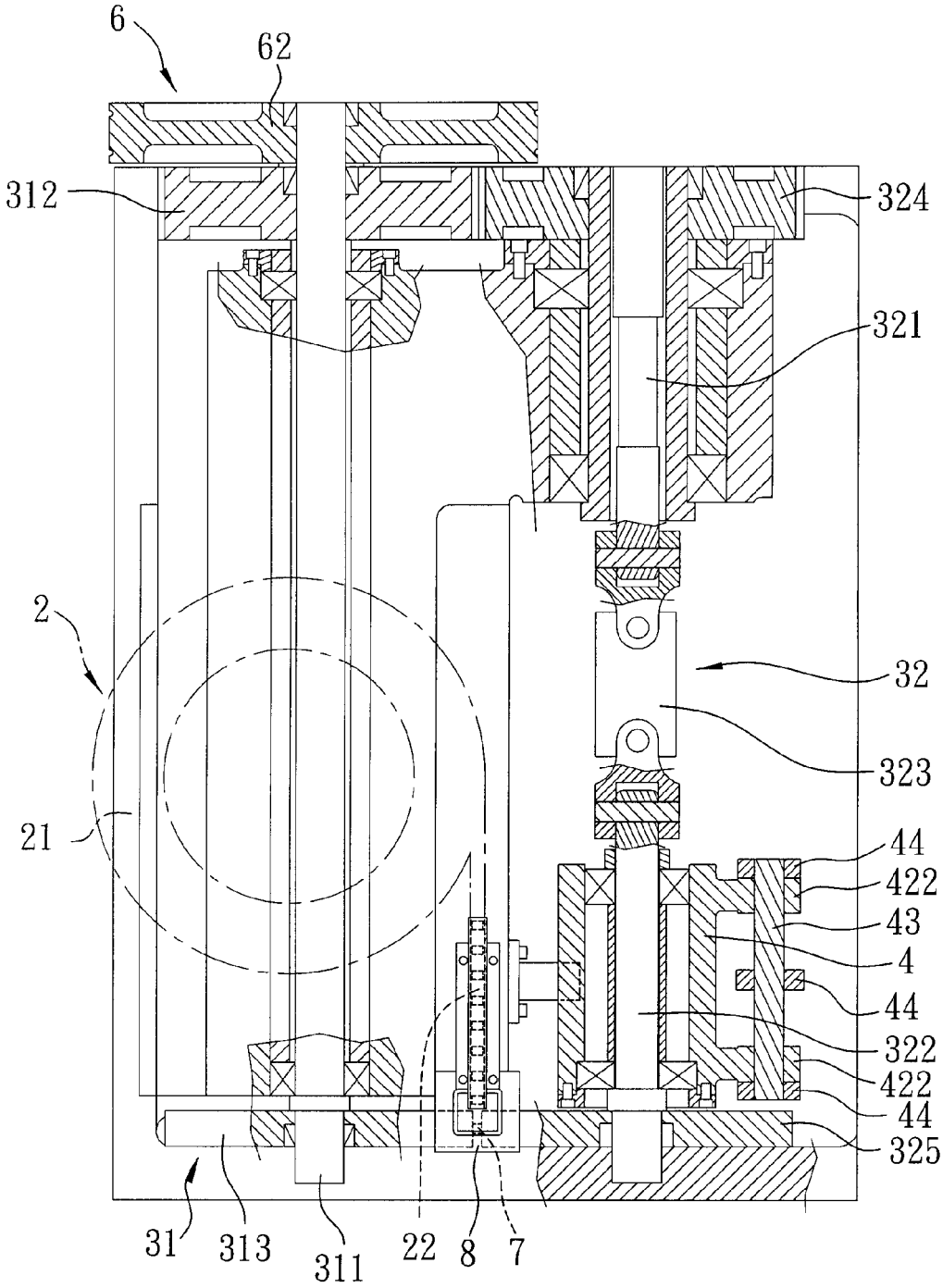
FIG. 5 is a partly sectional top view of the preferred embodiment.

As shown in FIGS. 3 to 5, the preferred embodiment of a roll pressing machine according to the present invention is adapted for pressing blanks 7 such as nuts, and comprises a base cabinet 11, a support 12 mounted on the base cabinet 11, a conveying unit 2, a stationary roller unit 31, a self-modulating roller unit 32, a swingable body 4, a plurality of biasing units 5, specifically, three biasing units 5 (only one is shown), and a power unit 6.

The conveying unit 2 includes a shaking tray 21 disposed above the base cabinet 11, a conveying component 22 connected to the shaking tray 21 and adapted for receiving blanks 7 advancing from the shaking tray 21, and a receiving container (not shown) for collecting products formed from the blanks 7. The conveying component 22 has an inlet section 221 connected to the shaking tray 21, an outlet section 222 opposite to the inlet section 221 and confronting the receiving container, and a roll pressing section 223 interconnecting the inlet section 221 and the outlet section 222.

The stationary roller unit 31 is disposed on the support 12, and has a stationary roller 313 proximate to the roll pressing section 223, a rotatable drive shaft 311 carrying the stationary roller 313, and a drive gear 312 disposed on the drive shaft 311 opposite to the stationary roller 313 and connected co-rotatably to the drive shaft 311.

The self-modulating roller unit 32 is disposed movably on the support 12, and includes a moving roller 325 adapted for pressing the blank 7 against the stationary roller 313 of the stationary roller unit 31, a swingable shaft 322 carrying the moving roller 325, a driven shaft 321, a universal joint 323, and a driven gear 324 disposed around the driven shaft 321 and meshing with the drive gear 312 of the stationary roller unit 31. The moving roller 325 is movable toward or away from the stationary roller 313 to vary a gap 8 between the stationary and moving rollers 313, 325. The universal joint 323 interconnects one end of the driven shaft 321 and one end of the swingable shaft 322 so that the swingable shaft 322 is pivotable relative to the driven shaft 321 while also being rotatable along with the driven shaft 321. The universal joint 323 includes two joint sections 3231 respectively connected to the driven shaft 321 and the swingable shaft 322 through horizontal pins 3233, and a middle section 3230 having two ends respectively connected to the joint sections 3231 through vertical pins 3232. The drive shaft 311 of the stationary roller unit 31 is disposed parallel to the driven shaft 321, and is connected drivingly to the driven shaft 321 through the meshing of the driven gear 324 with the drive gear 312. The roll pressing section 223 of the conveying unit 2 extends between the stationary roller unit 31 and the self-modulating roller unit 32.

The swingable body 4 is coupled to the moving roller 325 of the self-modulating roller unit 32, is disposed around the swingable shaft 322 of the self-modulating roller unit 32, and has a first lobe unit 421 projecting radially therefrom and connected pivotably to the support through a first lobe pivot 41, and a pair of second lobe units 422 projecting radially therefrom and spaced apart angularly from the first lobe unit 421. The first lobe unit 421 is pivotable relative to the support 12 to permit the swingable body 4 to move toward and away from the stationary roller 313 of the stationary roller unit 31. The swingable body 4 is rotatable about the first lobe pivot 41 in a first swinging direction 15 (as indicated by the arrow 15 in FIG. 3) when moving toward the stationary roller 313 and in a second swinging direction 16 (as indicated by the arrow 16 in FIG. 3) when moving away from the stationary roller 313. A second lobe shaft 43 extends through the second lobe units 422. In this embodiment, the swingable body 4 further has three pusher rollers 44 sleeved on the second lobe shaft 43.

The biasing units 5 are disposed under the pusher rollers 44 of the swingable body 4, respectively. Each of the biasing units 5 includes a pusher member 53 pushing resiliently the respective pusher roller 44, a spring casing 51 mounted on the support 12 and receiving movably one end of the pusher member 53, and a spring 54, such as a compression spring, disposed in the spring casing 51 and having one end abutting against the pusher member 53 so that the pusher member 53 pushes resiliently the respective pusher roller 44 of the swingable body 4. The other end of the spring 54 abuts against an adjustment screw 52. The pusher member 53 of each biasing unit 5 has an extending portion 531 connected to the respective one of the pusher rollers 44 and resiliently pushing the respective pusher roller 44 to rotate the swingable body 4 in the first direction 15, and a press portion 532 connected to the extending portion 531 and abutting against the spring 54.

The power unit 6 supplies power to the stationary roller unit 31 and the self-modulating roller unit 32, and includes a motor 61 disposed in the base cabinet 11, and a transmission component 62 coupled to the drive shaft 311 of the stationary roller unit 31 and driven rotatably by the motor 61. In this embodiment, the transmission component 62 is a pulley, and a belt 63 is trained on an output component 611 of the motor 61 and the transmission component 62 (see FIG. 4).

In use, the stationary roller unit 31 is driven by the transmission component 62 of the power unit 6 to rotate in a first direction 13 (as indicated by the arrow 13 in FIG. 3), while the self-modulating roller unit 32 is driven to rotate in a second direction 14 (as indicated by the arrow 14 in FIG. 3) opposite to the first direction 13. In this embodiment, the first direction 13 is a clockwise direction, and the second direction 14 is a counterclockwise direction. When the blanks 7 advanced from the shaking tray 21 of the conveying unit 2 are conveyed from the inlet section 221 of the conveying component 22 to the roll pressing section 223 of the conveying component 22, one of the blanks 7 that extends into the gap 8 formed between the stationary roller 313 of the stationary roller unit 31 and the moving roller 325 of the self-modulating roller unit 32 will be pressed, and the blank 7 after being pressed will be conveyed to the outlet section 222 of the conveying component 22.

As shown in FIGS. 3 and 5, when one of the blanks 7 is being passed between the stationary roller 313 of the stationary roller unit 31 and the moving roller 325 of the self-modulating roller unit 32, the moving roller 325 moves away from the stationary roller 313 due to the counteracting of the blank 7. However, as the spring 54 of the biasing unit 5 biases the pusher member 53 of the biasing unit 5 to push the respective pusher roller 44 of the swingable body 4 and to thereby rotate the swingable body 4 in the first swinging direction 15, the moving roller 325 is urged to move toward the stationary roller 313 for pressing the blank 7 against the stationary roller 313.

Figure 6:
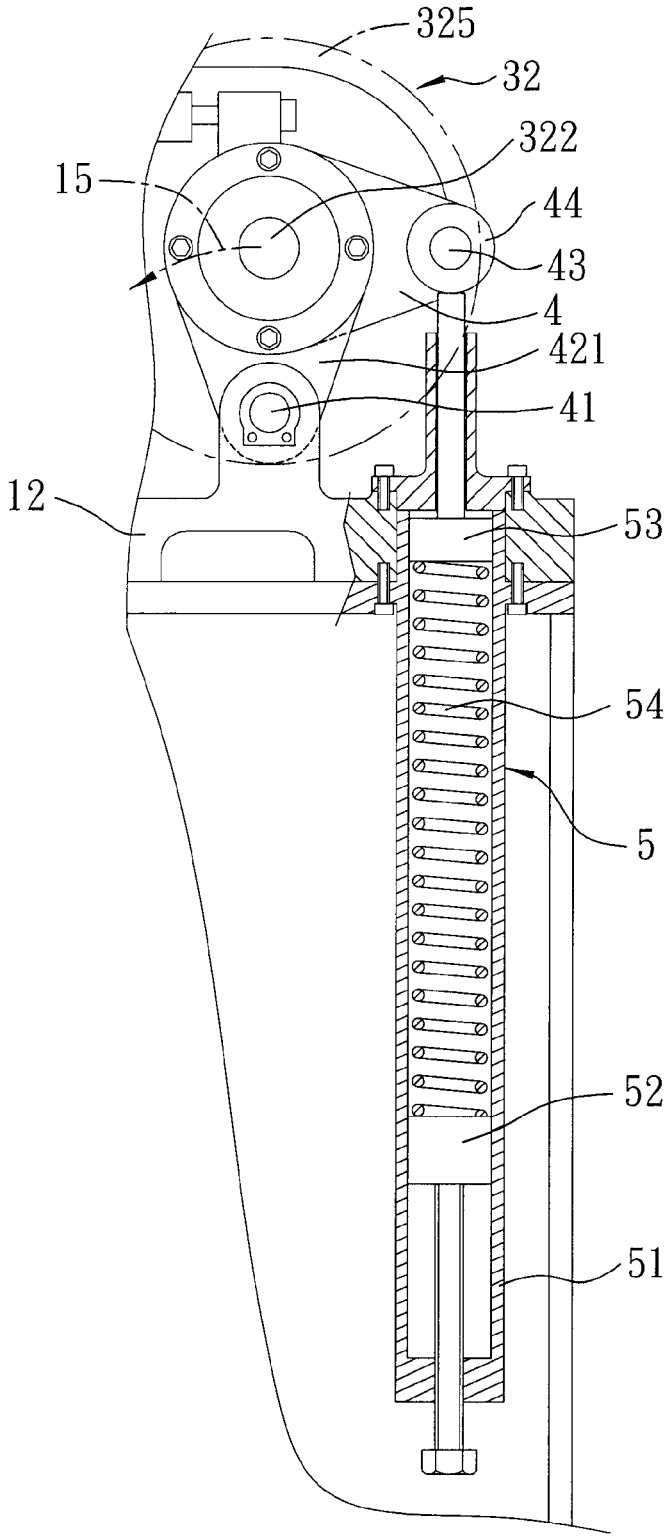
FIG. 6 is an enlarged fragmentary sectional view of the preferred embodiment, illustrating a biasing unit and a swingable body that rotates in a first direction.
Figure 7:
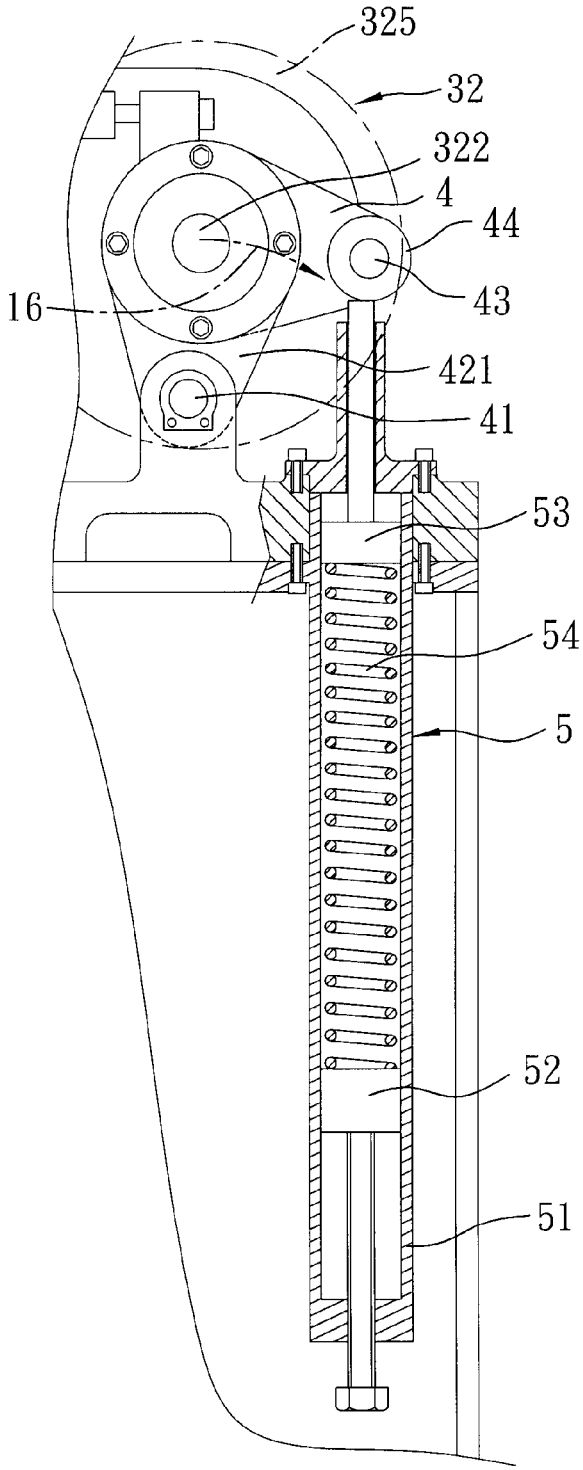
FIG. 7 is a view similar to FIG. 6, but illustrating the swingable body that rotates in a second direction.

Reference is made to FIGS. 3, 5, 6, and 7. When a blank 7 that has a longer outer diameter is being pressed by the stationary roller 313 of the stationary roller unit 31 and the moving roller 325 of the self-modulating roller unit 32, it will apply reaction forces to the stationary roller 313 and the moving roller 325. Since the stationary roller 313 is fixed, only the moving roller 325 will be moved by the reactive force, such that the swingable body 4 coupled to the moving roller 325 will rotate about the first lobe pivot 41 of the swingable body 4 in the second swinging direction 16, as shown in FIG. 7. If the blank 7 is smaller, the moving roller 325 is rotated about the first lobe pivot 41 in the first swinging direction 15 as shown in FIG. 6. Therefore, if the outer diameter of the blank 7 is small, the moving roller 325 is moved toward the stationary roller 313 so that a sufficient pressure can be applied to the blank 7 to provide proper contraction of the blank 7. In case the outer diameter of the blank 7 is large, the moving roller 325 is moved away from the stationary roller 313 so that the pressure applied to the blank 7 will not be excessive. With the roll pressing machine according to the present invention that can apply different pressing forces suitable for varying dimensions of blanks, self-locking nuts can be provided with substantially the same dimensional contraction in the screw holes thereof.

It should be noted that, the pusher rollers 44 are disposed for reducing the friction between the pusher members 53 of the biasing unit 5 and the second lobe shaft 43 of the second lobe unit 422 of the swingable body 4. However, they may be omitted, and the pusher member 53 may be arranged to push directly the second lobe shaft 43. In addition, while this invention is exemplified using three biasing units 5, only one biasing unit 5 may be employed in other embodiments of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A roll pressing machine comprising:

a support;

a stationary roller unit disposed on said support and having a stationary roller;

a self-modulating roller unit disposed movably on said support and including a moving roller adapted for pressing a blank against said stationary roller, said moving roller being movable toward or away from said stationary roller;

a swingable body that is coupled to said moving roller; and a biasing unit including a pusher member that pushes resiliently said swingable body so that said moving roller moves toward said stationary roller;

wherein said self-modulating roller unit further includes a swingable shaft carrying said moving roller, said swingable body being disposed around said swingable shaft, and having a first lobe unit projecting radially therefrom and connected pivotably to said support, and a second lobe unit projecting radially therefrom and spaced apart angularly from said first lobe unit, said first lobe unit being pivotable relative to said support to permit said swingable body to move toward and away from said stationary roller; and wherein said second lobe unit has a second lobe shaft extending through said second lobe unit and pushed by said pusher member, and a pusher roller sleeved on said second lobe shaft and connected to said pusher member.

2. The roll pressing machine as claimed in claim 1, wherein said biasing unit further includes a spring casing mounted on said support and receiving movably one end of said pusher member, and a spring disposed in said spring casing and urging against said pusher member so that said pusher member pushes resiliently said second lobe unit.

3. The roll pressing machine as claimed in claim 1, wherein said self-modulating roller unit further includes a driven shaft, and a universal joint interconnecting one end of said driven shaft and one end of said swingable shaft so that said swingable shaft is pivotable relative to said driven shaft while also being rotatable along with said driven shaft.

4. The roll pressing machine as claimed in claim 3, wherein said stationary roller unit further includes a drive shaft carrying said stationary roller and parallel to said driven shaft, said drive shaft being connected drivingly to said driven shaft.

5. The roll pressing machine as claimed in claim 4, wherein:

said stationary roller unit further includes a drive gear connected co-rotatably to said drive shaft; and said self-modulating roller unit further includes a driven gear disposed around said driven shaft and meshing with said drive gear.

* * * * *